US009856850B1

(12) United States Patent
Sheehan

(10) Patent No.: US 9,856,850 B1
(45) Date of Patent: Jan. 2, 2018

(54) APPARATUS, SYSTEM AND METHOD FOR PRODUCING ROTATIONAL TORQUE TO GENERATE ELECTRICITY AND OPERATE MACHINES

(71) Applicant: Larry L. Sheehan, Payson, AZ (US)

(72) Inventor: Larry L. Sheehan, Payson, AZ (US)

( * ) Notice: Subject to any disclaimer, the term of this patent is extended or adjusted under 35 U.S.C. 154(b) by 221 days.

(21) Appl. No.: 15/006,086

(22) Filed: Jan. 25, 2016

(51) Int. Cl.
*F03B 17/00* (2006.01)

(52) U.S. Cl.
CPC ..... *F03B 17/005* (2013.01)

(58) Field of Classification Search
CPC ..... F03B 17/005; F03B 13/06; Y02E 10/38; Y02E 10/22; Y02E 10/32
See application file for complete search history.

(56) References Cited

U.S. PATENT DOCUMENTS 4,443,707 A * 4/1984 Scieri ..... F03B 13/06 290/4 A
2010/0253080 A1* 10/2010 DeAngeles ..... F03B 13/06 290/52
2012/0297759 A1* 11/2012 Chiu ..... F15B 3/00 60/398
2013/0307272 A1* 11/2013 Smith ..... F01D 15/10 290/50

* cited by examiner

*Primary Examiner* — F. Daniel Lopez
*Assistant Examiner* — Abiy Teka
(74) *Attorney, Agent, or Firm* — Richard A. Ryan

(57) ABSTRACT

An apparatus, system and method for utilizing a source of liquid to rotate an output shaft and produce rotational torque that operates a machine to produce electricity, operate a pump or accomplish other work. Liquid from the supply of liquid flows into a flow chamber where the liquid is mixed with pressurized gas to form an aerated flow stream that flows upward in the flow chamber to lift the liquid to a position above a liquid-driven rotating mechanism, such as a water turbine or open impeller. The liquid is directed to the rotating mechanism by liquid discharge devices. Liquid passing through the rotating mechanism rotates the output shaft and then flows back into the supply of liquid. A supply of pressurized gas supplies the gas to the flow chamber. Gas discharge vents remove the gas from the aerated flow stream upstream of the liquid discharge devices.

20 Claims, 5 Drawing Sheets

APPARATUS, SYSTEM AND METHOD FOR PRODUCING ROTATIONAL TORQUE TO GENERATE ELECTRICITY AND OPERATE MACHINES

CROSS-REFERENCE TO RELATED APPLICATIONS

None.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The field of the present invention relates generally to apparatuses, systems and methods for producing rotational torque through an output shaft so the rotating shaft may be utilized to generate electricity or operate machines. More particularly, the present invention relates to such apparatuses that are generally configured as a micro-hydroelectric generator and systems and methods that use such generators to generate electricity or operate pumps or other machines. Even more particularly, the present invention relates to such apparatuses that are relatively simple and inexpensive to manufacture, require little ongoing maintenance and are efficient at producing rotational torque.

B. Background

Motors and other machines for converting a source of input energy to an output in the form of rotational torque that is delivered through an output shaft have been generally available for many years. The rotational torque at the output shaft is commonly utilized to produce electricity via a generator or power a pump, grinding wheel or other machine, turn a wheel and operate other devices. The input energy for such machines has been provided by people, animals, moving water, gravity, blowing wind, fossil fuels, nuclear materials and a variety of other sources. Over the years, there has been a desire to have machines which utilize energy from readily available, clean and renewable sources, such as water, wind or the sun, instead of using the limited more polluting sources of energy, such as petroleum, coal, uranium and the like. With regard to machines which use the power of moving water or wind, these machines are generally configured to result in a force differential, provided by the force of the moving water or wind, on opposite sides of the machine's wheel or fan blades in order to rotate a shaft that is fixedly connected to the wheel or fan blades. The ideal configuration for such machines is to have as much of a force imbalance as possible on opposite sides of the wheel or fan blades so that the machine will generate the maximum amount of rotational torque at the output shaft. In general, the various components of these water or wind powered machines are beneficially shaped and configured in an attempt to achieve this objective.

With regard to generating electricity, apparatuses, systems and methods for converting a source of energy to useful power for generating electricity have been generally available for many years. A common arrangement for generating electricity is a large power plant that delivers the produced electricity to the end user over long distance, often very long distance, transmission lines. As is commonly known, such power plants are very complicated and very expensive, requiring large capital investment in the power plant and the transmission lines. Presently, most large power plants rely on traditional sources of energy, such as oil, natural gas, coal, nuclear, stored water and the like to produce electricity. There is a strong effort to provide alternative apparatuses and systems to power machines, particularly generators for producing electricity, that utilize energy sources which have less environmental impact, generally by being more readily available, cleaner and, preferably, renewable. For instance, many people and organizations have been attempting to utilize wind, solar, tidal and geothermal resources as a source of power to operate generators for the production of electricity. Although such sources of energy have been well known and, to some extent, in use for many years, it has only been relatively recent that substantially increased efforts have been directed towards improving the efficiency of these energy systems so they may be capable of generating more electricity. Currently, such alternative energy systems are a relatively small percentage of the total electricity production.

In general, the increased push for apparatuses and systems that generate electricity without utilizing conventional, non-renewable and polluting energy sources is a direct result of an increase in the number of devices which are powered by electricity, such as computers, air conditioning, vehicles, audio systems, kitchen appliances and a vast number of other devices, and the rapid expansion in the number of people who desire to utilize such devices. As is well known in the art, the increase in the supply of electricity to meet this demand will have to be supplied by those apparatuses and systems that are available, which, at least presently, primarily rely on hydrocarbon-based fuels. In general, as the need for electricity increases, the supply of fuel to produce electricity is further reduced, the environmental impacts of utilizing certain fuels worsen and the cost of using electricity increases. Most experts expect that the demand for electricity will substantially increase during the foreseeable future. In addition, consumers generally expect that electricity will be available to them when they need it, whether to operate an appliance, energize a light source, operate a machine, provide power to operate motor vehicles and other uses.

Although electricity is most often produced and provided to the public by large power plants via long distance transmission lines, as set forth above, there is a strong desire by many people for the apparatuses, systems and methods that are able to generate electricity at or very near the location where it will be utilized. One advantage of such electricity production is that it eliminates the requirement to transmit electricity over long distances, thereby eliminating the cost to build long distance transmission lines, the cost of acquiring the right-of-way for the land and the use of the land to support those lines. For areas that are somewhat off of the normal power grid, the cost of building the necessary transmission lines and the cost to maintain those lines can be significant. To be effective, however, an apparatus, system and method for localized production of electricity must be of sufficient size to supply the desired amount of electricity and must be able to reliably supply that electricity. Presently, small wind, water and solar generators and generating systems for localized production of electricity are generally not widely utilized.

What is needed, therefore, is an improved apparatus for producing rotational torque that can be utilized to generate electricity and operate pumps and other machines and improved systems and methods of producing rotational torque that utilizes such apparatuses. The new apparatus should be configured to rotate a shaft that can be connected to an electrical generator, pump or other machine to accomplish useful work, such as generating electricity, pumping water or the like. The new system and method of the present invention should be configured to utilize the new apparatus to accomplish the desired work. In a preferred configuration, the new apparatus, system and method should generally be configured to utilize the force of moving liquid, such as water, to rotate a propellor or like device attached to a shaft so as to rotate a shaft for localized generation of electricity or operation of a pump or other machine. Preferably, the new apparatus is relatively simple and inexpensive to manufacture, requires little ongoing maintenance and is efficient at producing rotational torque.

SUMMARY OF THE INVENTION

The apparatus, system and method of the present invention provides the benefits and solves the problems identified above. That is to say, the apparatus, system and method of the present invention is generally configured as a micro-hydroelectric generator which uses the directed force of moving liquid, such as water, to rotate a shaft to produce rotational torque that can be beneficially utilized to generate electricity, operate a pump or accomplish other useful work. More specifically, the apparatus utilizes the force of moving liquid to rotate a water-driven rotating mechanism, comprising a propellor, turbine or like device, that is attached to shaft so as to rotate a shaft and produce rotational torque which can operate a work machine. In the preferred configuration, the apparatus, system and method of the present invention are adaptable to produce electricity, operate a pump or accomplish other useful work at the house, office, business or other location where the electricity or other work operation will be utilized. As will be readily appreciated by persons skilled in the art, the apparatus of the present invention is relatively simple and inexpensive to manufacture, requires little ongoing maintenance and is efficient at producing rotational torque.

In one embodiment of the present invention, the new apparatus generally comprises a source of liquid, one or more flow chambers, a source of pressurized gas, an output shaft, a liquid-driven rotating mechanism, one or more liquid discharge devices and one or more gas discharge vents. The source of liquid, which has an upper end and a lower end, is configured to allow a liquid to flow into it at or near its upper end and to allow the liquid to flow out an outlet at or near its lower end. Each of the flow chambers has an upper end and a lower end. The flow chambers are hydraulically connected to the outlet of the source of liquid at or near the lower end of the flow chambers to receive liquid from the source of liquid through the outlet. The upper ends of the flow chambers are positioned above the source of liquid such that the liquid will flow from the flow chambers downward to the source of liquid upon exiting the flow chambers (after passing through the liquid-driven rotating mechanism). The source of pressurized gas is configured to direct gas into each of the one or more flow chambers at or near the lower end of the flow chambers. The pressurized gas will mix with the liquid and form an aerated flow stream that flows upward from the lower end to the upper end of the flow chambers. The output shaft is configured to be operatively engaged by the work machine to accomplish the desired work objective, such as generating electricity, operating a pump or the like.

The liquid-driven rotating mechanism is positioned between the upper end of the flow chambers and the source of liquid so it will receive liquid discharged from the flow chambers. The liquid-driven rotating mechanism is attached to or integral with the output shaft so when the mechanism rotates in response to the liquid passing through it, the mechanism will rotate the output shaft to produce rotational torque that is utilized by the work machine through the rotating output shaft. A liquid discharge device is associated with each of the flow chambers at or near the upper end of the flow chambers. The liquid discharge devices are configured to discharge the liquid from the flow chambers downward toward to the liquid-driven rotating mechanism to rotate the output shaft. A gas discharge vent is associated with each of the flow chambers at or near the upper end of the flow chambers generally upstream of the liquid discharge devices. The gas discharge vents are configured to discharge the gas from the aerated flow stream to substantially flow liquid downstream of the gas discharge vents to the liquid discharge devices. In operation, liquid hydrostatically flows from the source of liquid into each of the one or more flow chambers to mix with the gas from the source of pressurized gas and produce the aerated flow stream that lifts the liquid above the liquid-driven rotating mechanism where the liquid is directed by the liquid discharge devices to the liquid-driven rotating mechanism to rotate the output shaft and operate the work machine.

In one embodiment, the source of liquid is a storage tank having one or more sidewalls and the flow chambers are defined by tubular members. In another embodiment, the storage tank and the flow chambers are disposed in a housing having a plurality of internal walls that define the flow chambers and, in one configuration, support the liquid-driven rotating mechanism above the storage tank. The apparatus can have a hydrostatic head area disposed in the housing between the upper end of the flow chambers and the liquid-driven rotating mechanism, with the hydrostatic head area being sized and configured to receive the liquid from the flow chambers and to flow the liquid to the liquid-driven rotating mechanism to rotate the output shaft. The liquid-driven rotating mechanism can comprise an open impeller disposed in a chamber of a diffuser and/or a water turbine. In another embodiment, the gas discharge vents can be pneumatically connected to a closed-loop gas supply comprising a gas vessel for storing the gas, a gas inlet line for delivering the gas from the gas discharge vents to the gas vessel and a gas outlet line for delivering the gas to the source of pressurized gas. In another embodiment, the gas discharge vents can connect directly to the source of pressurized gas. The source of pressurized gas can be a gas pump that is connected to a source of power, with the source of power selected so as to power the gas pump and pressurize the gas. In one embodiment, the gas pump is electrically powered and the source of power is one or more solar panels. To better separate the gas from the aerated flow stream, the apparatus can have one or more gas/liquid separating devices located generally at or upstream of the gas discharge vents. The liquid discharge devices can have a nozzle to pressurize the liquid from the flow chambers and/or beneficially direct the liquid from the flow chambers to the liquid-driven rotating mechanism to achieve increased or more efficient rotation of the mechanism.

In one embodiment of the system of the present invention, the new system for operating a work machine generally comprises the above-described apparatus and the work machine and source of power. The work machine is selected to accomplish the desired work objective, such as generate electricity or operate a pump. The source of power provides power to operate the gas pump or other source of pressurized gas.

In one embodiment of the method of the present invention, the new method for producing rotational torque for accomplishing a work objective generally comprises the steps of: (a) providing an apparatus configured as described above; (b) flowing liquid from the source of liquid into the flow chambers; (c) injecting gas from the source of pressurized gas into the flow chambers to mix with the liquid and produce an aerated flow stream inside the flow chambers; (d) flowing the aerated flow stream upward inside the flow chambers to a position above the liquid-driven rotating mechanism; (e) discharging the gas through the gas discharge vents; (f) discharging the liquid from the liquid discharge devices toward the liquid-driven rotating mechanism; (g) rotating the liquid-driven rotating mechanism with the liquid to rotate the output shaft; (h) flowing the liquid back into the source of liquid; and (i) operating the work machine with the rotating output shaft to accomplish the work objective. In another embodiment, the method can comprise the step of separating the gas from the aerated flow stream prior to the gas discharging step. In yet another embodiment, the method can included the step of flowing the gas from the gas discharge vents to a closed-loop gas supply to direct the gas back to the source of pressurized gas after the gas discharging step.

Accordingly, the primary object of the present invention is to provide a new apparatus, system and method for producing rotational torque that has the advantages discussed above and which overcomes the various disadvantages and limitations that are associated with presently available apparatuses, systems and methods for producing rotational torque.

It is an important object of the present invention to provide a new apparatus, system and method of producing rotational torque that is structured and arranged to utilize the force of moving water to operate a water-driven rotating mechanism that rotates a shaft to operate a work machine to generate electricity, operate a pump or accomplish other useful work.

An important aspect of the present invention is that it provides a new apparatus, system and method for producing rotational torque that accomplishes the objectives set forth above.

Another important aspect of the present invention is that it provides an apparatus, system and method for producing rotational torque that comprises a water-driven rotating mechanism that utilizes the directed force of moving water to rotate a shaft and operate a work machine to generate electricity, operate a pump or other machine or accomplish other useful work.

Another important aspect of the present invention is that it provides an apparatus, system and method for producing rotational torque that is generally configured as a micro-hydroelectric generator which uses the hydrostatic head created by lifted water to direct moving water to a water-driven rotating mechanism that rotates a shaft, with the water being lifted by utilizing a source of pressurized gas to reduce the energy required to lift the liquid.

Another important aspect of the present invention is that it provides an apparatus, system and method that utilizes an aerated liquid stream inside a flow chamber to lift the liquid portion of the stream to produce hydrostatic head that is utilized by a micro-hydroelectric generator to produce rotational torque which can be beneficially utilized by a work machine.

Another important aspect of the present invention is that it provides an apparatus, system and method for producing rotational torque that is generally configured as a micro-hydroelectric generator to operate a work machine that can be beneficially utilized at a house, office, business or other location where the work machine is located for localized generation of electricity or other work operation.

Yet another important aspect of the present invention is that it provides an apparatus, system and method for producing rotational torque that is relatively simple and inexpensive to manufacture, requires little ongoing maintenance and is efficient at producing rotational torque.

As will be explained in greater detail by reference to the attached figures and the description of the preferred embodiment which follows, the above and other objects and aspects are accomplished or provided by the present invention. As set forth herein and will be readily appreciated by those skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the various components of the new apparatus, system and method of the present invention, those skilled in the art will readily appreciate that the present invention is not so limited. In addition, the exemplary embodiments of the present device are shown and described with only those components which are required to disclose the present invention. Many of the necessary electrical and mechanical elements for powering, attaching and using the present invention are not shown or necessarily described below, but which are well known to persons skilled in the relevant art. As will be readily appreciated by such persons, the various elements of the present invention that are described below may take on any form consistent with forms that are readily realized by a person of ordinary skill in the art having knowledge of apparatuses, systems and methods for producing rotational torque.

Figure 1:
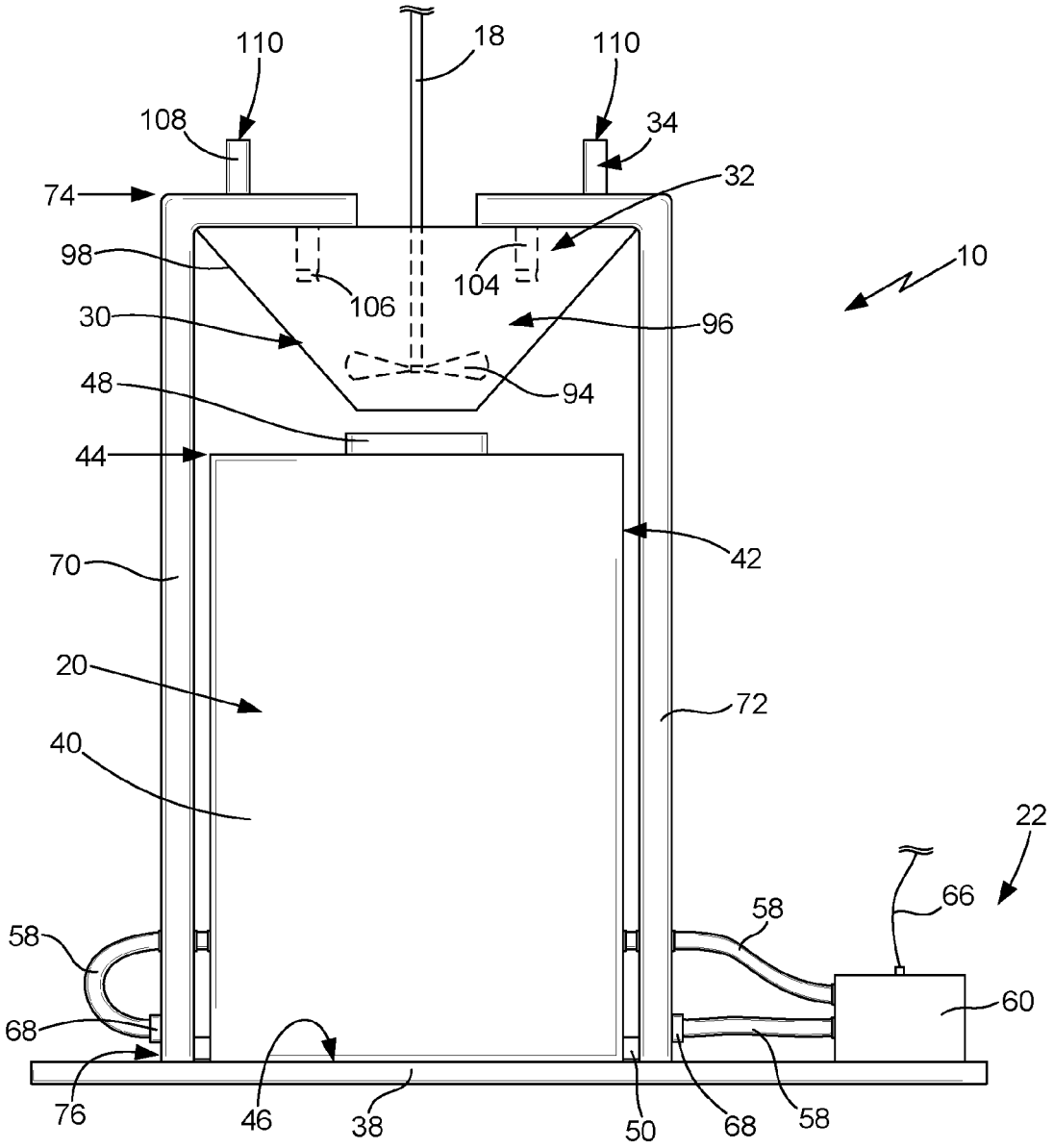
FIG. 1 is a side view of an apparatus that is configured according to a first embodiment of the present invention, with the apparatus comprising a pair of tubular members defining the flow chambers through which the aerated flow stream passes to deliver liquid to the liquid-driven rotating mechanism.
Figure 2:
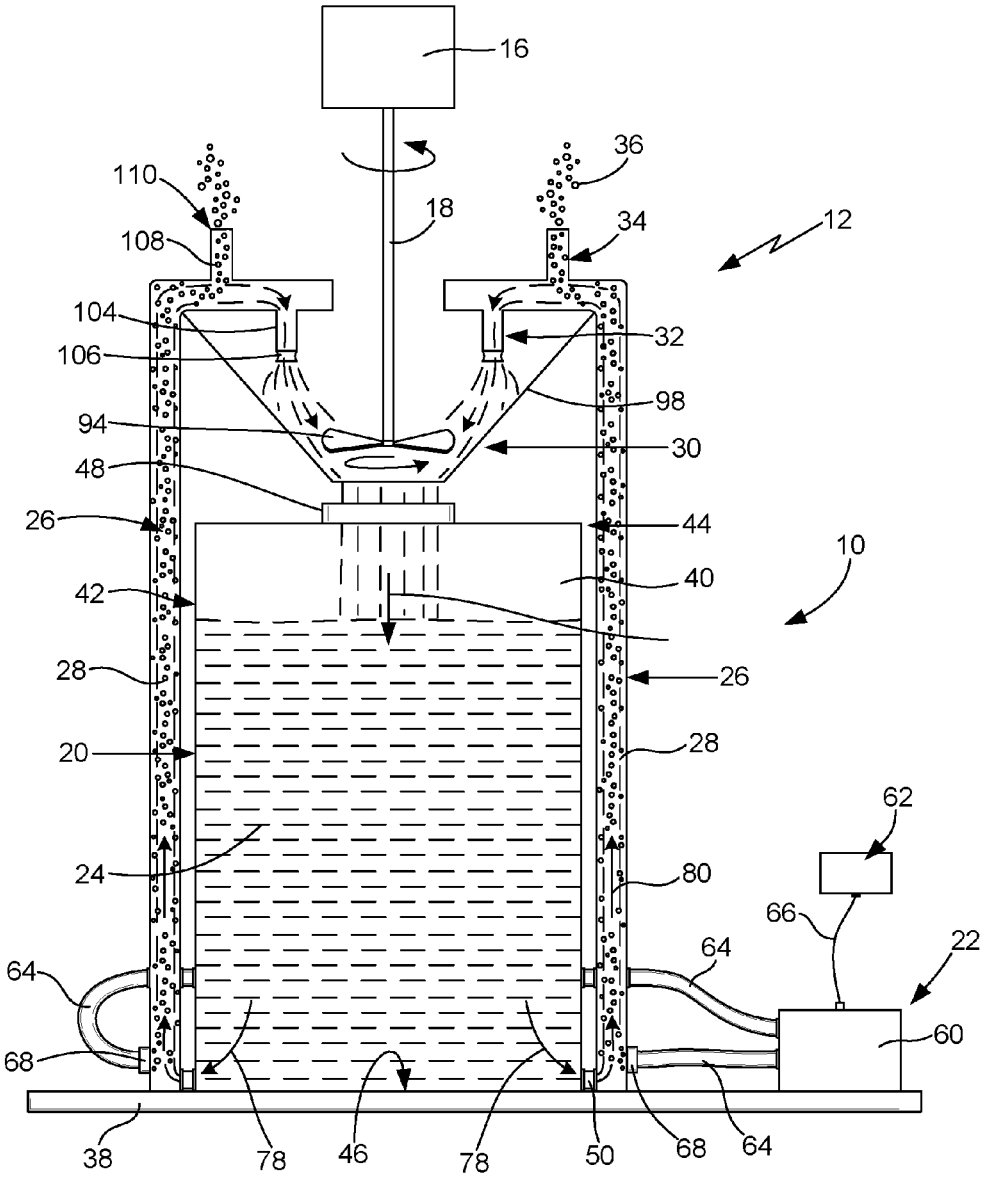
FIG. 2 is a side view of a system that is configured according to a first embodiment of the present invention shown in use to rotate a shaft and operate a work machine with the apparatus of FIG. 1, with the apparatus shown in cross-sectional side view to better illustrate the mechanical and fluid-flow operation of the system.
Figure 3:
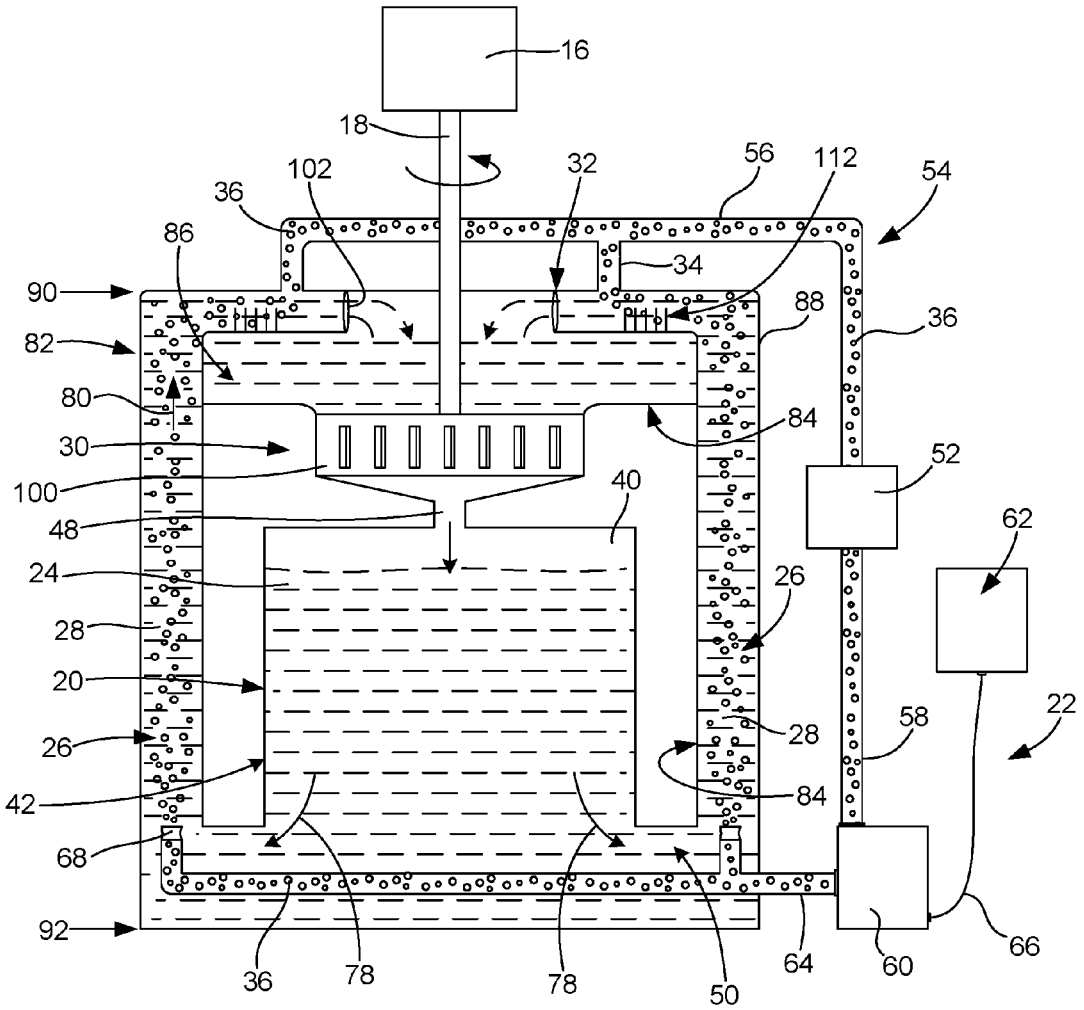
FIG. 3 is a side view of a system that is configured according to a second embodiment of the present invention shown in use to rotate a shaft and operate a work machine, with apparatus shown in cross-sectional side view to show the flow chamber defined by the outer walls of the housing which encloses the apparatus.
Figure 4:
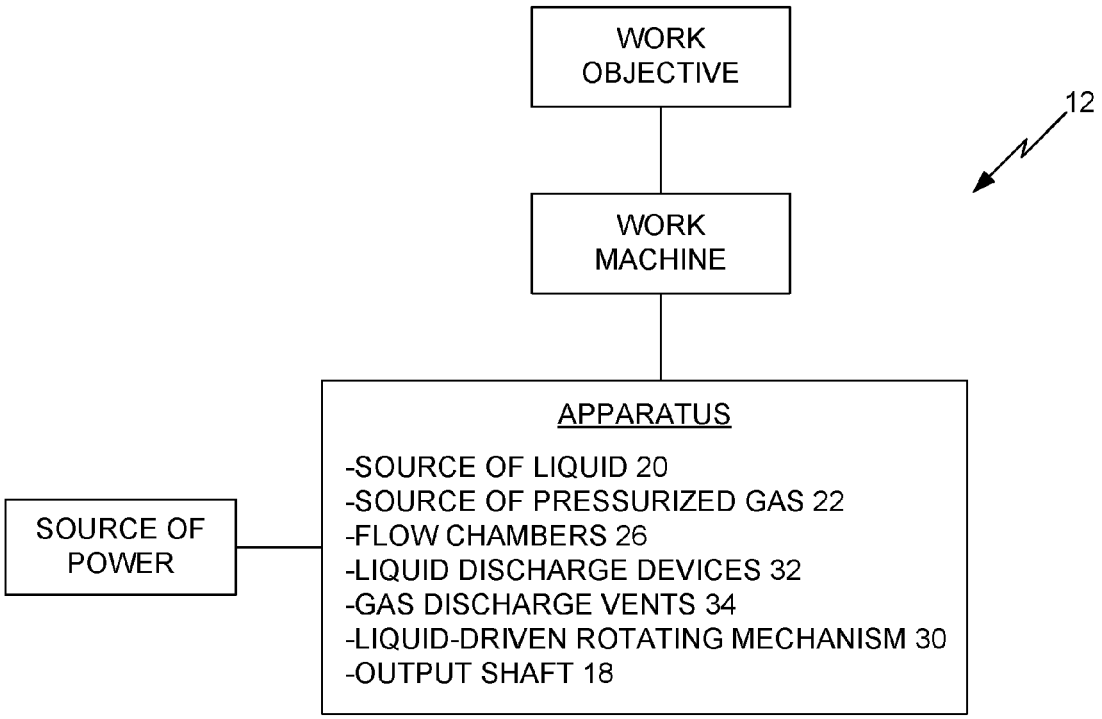
FIG. 4 is a diagram illustrating an embodiment of the system of the present invention to accomplish a work objective.
Figure 5:
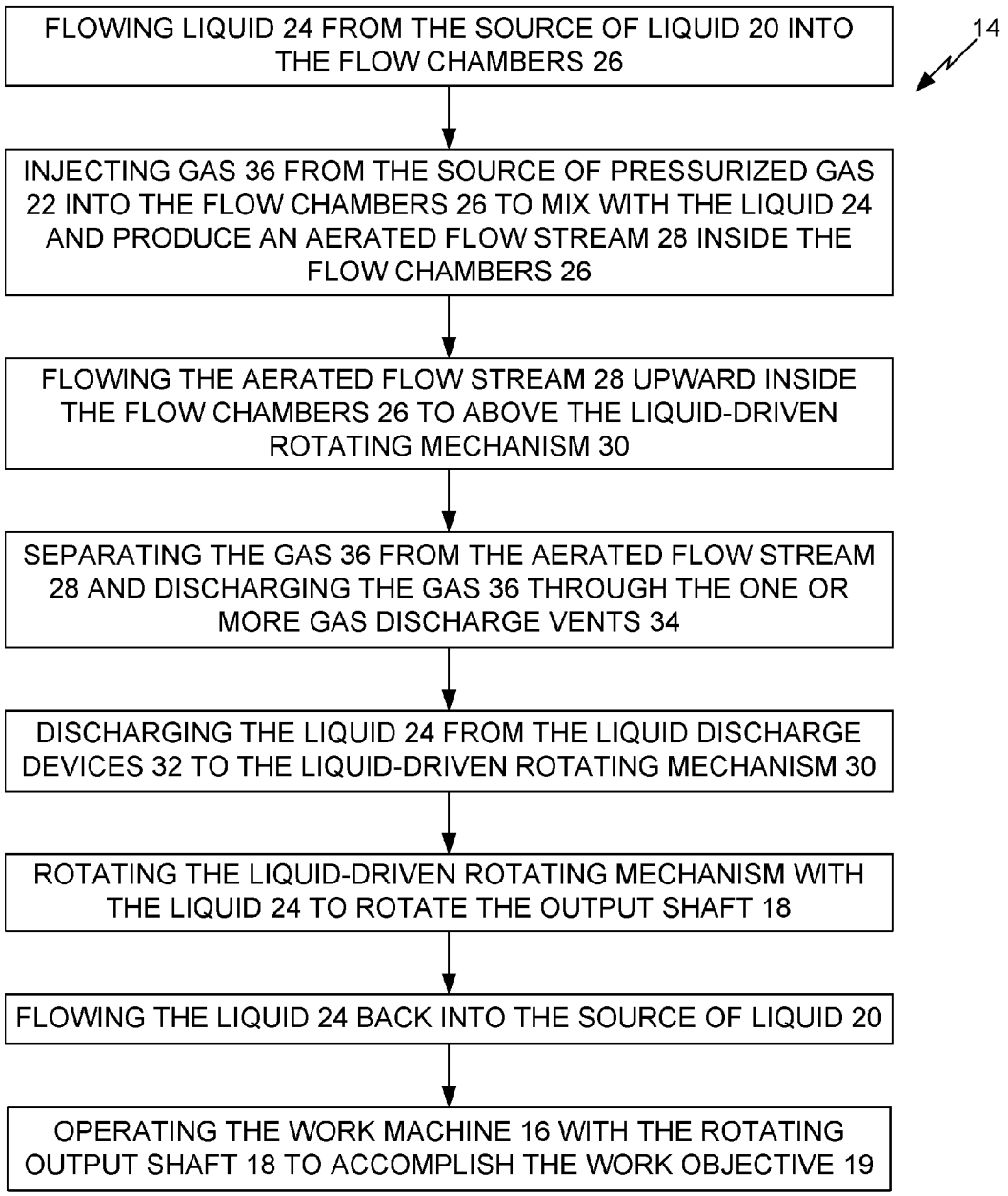
FIG. 5 is a flow chart illustrating an embodiment of the method of the present invention to accomplish a work objective.

An apparatus that is configured pursuant to preferred embodiments of the present invention is shown generally as 10 in FIG. 1. A system for producing rotational torque using the new apparatus 10 is shown as 12 in FIGS. 2-4. A new method of producing rotational torque is shown as 14 in FIG. 5. As set forth in more detail below, the apparatus 10 of the present invention is structured and arranged to provide rotational torque to an electrical generator or other work machine 16, such as an alternator, pump, wheel or the like, through an output shaft 18, as best shown in FIGS. 2 and 3. The output shaft 18 is operatively connected to the work machine 16, to accomplish the desired work objective 19, as shown in FIGS. 4 and 5, such as generating electricity, pumping, milling or the like. The system 12 and method 14 of the present invention utilize the apparatus 10 to produce the rotational torque necessary to accomplish the objectives of operating the work machine 16 to achieve the work objective 19. As will be readily appreciated by persons skilled in the art, the components of the apparatus 10 may be selected to be of a size and configuration that can be utilized for the localized generation of electricity and/or operation of other work machines 16.

In a preferred configuration, the apparatus 10 of the present invention is configured generally as a micro hydro generator having a source of liquid 20, a source of pressurized gas 22 to aerate liquid 24 from the source of liquid 20, one or more upwardly directed flow chambers 26 that flow the aerated liquid 28 upward to produce hydrostatic head, a liquid-driven rotating mechanism 30 that receives liquid 24 from one or more liquid discharge devices 32 that are hydraulically connected to the flow chambers 26 to rotate the output shaft 18 and one or more gas discharge vents 34 that discharge gas 36 which is separated from the aerated liquid 28. In the embodiments of FIGS. 1 and 2, the apparatus 10 is mounted on a platform 38 for ease of movement and set-up. As set forth in more detail below, liquid 24 from the source of liquid 20 flows into the one or more flow chambers 26 where the source of pressurized gas 22 injects gas 36 into the liquid 24 to create the aerated flow stream 28 that rises above the liquid-driven rotating mechanism 30, where gas discharge vents 34 allow the gas 36 to separate from the aerated flow stream 28. The liquid 24 from the aerated flow stream 28 is directed through the liquid discharge devices 32 to the liquid-driven rotating mechanism 30 which, in response to the hydrostatic head and/or flow rate from the liquid discharge devices 32, rotates the output shaft 18 to provide rotational torque at the work machine 16 to accomplish the desired work objective 19, such as generate electricity, operate a pump or the like.

In one embodiment, the liquid 24 is water. In other embodiments, the liquid 24 can be a combination of water and various chemicals, preferably of the non-toxic, environmentally safe type, that provide useful benefits to the liquid 24, such as lowering the freezing point to prevent the liquid 24 from freezing at temperatures commonly found in the environment which the apparatus 10 will be utilized and to reduce or prevent corrosion. As will be readily appreciated by persons who are skilled in the art, a wide variety of other liquids can be utilized for the liquid 24 that drives the liquid-driven rotating mechanism 30.

The source of liquid 20 for apparatus 10, system 12 and method 14 of the present invention can be subject to a wide variety of different configurations. In a preferred configuration of the present invention, however, the source of liquid 20 is a container such as a storage tank 40 or the like having one or more sidewalls 42 with an upper end 44 and a lower end 46, as best shown in FIGS. 1 and 3. The storage tank 40 for apparatus 10 can be round, square, rectangular or a variety of other shapes. The storage tank 40 has at least one tank inlet 48 at or near the upper end 44 and one or more tank outlets 50 at or near the lower end 46. For purposes of describing the present invention, the terms "upper" and "lower" are utilized to reference positions of the apparatus 10 relative to the gravitational flow of the liquid 24. For example, the liquid 24 in the storage tank will flow under hydrostatic pressure from the upper end 44 to the lower end 46 thereof. In one embodiment, the tank inlet 48 is the upper end 44 of the storage tank 40 being entirely open. In the embodiment shown in the figures, the majority of the upper end 44 of the storage tank 40 is closed except for the tank inlet 48 where the liquid 24 is discharged (as explained below) from the liquid-driven rotating mechanism 30 and enters storage tank 40. If desired, the tank inlet 48 can be directly connected to the liquid-driven rotating mechanism 30, as shown in FIG. 3, to receive the liquid 24 therefrom. In a typical configuration, the lower end 46 of the storage tank 40 is closed with the tank outlets 50 positioned generally at or slightly above the closed lower end 46, as shown in FIGS. 1 and 2. As set forth in more detail below, liquid 24 from inside the storage tank 40 will flow through the tank outlets 50 to the flow chambers 26.

As set forth above, the apparatus 10, system 12 and method 14 of the present invention utilize a source of pressurized gas 22 to direct gas 36 into the flow chambers 26 to aerate the liquid 24 and create an aerated flow stream 28 that rises upward in the flow chambers 26. A wide variety of gases can be utilized as gas 36 for the apparatus 10 of the present invention. The gas 36 must be selected in combination with the liquid 24 so that injected pressurized gas 36 will be able to lift the liquid 24, via aerated flow stream 28, from the lower end 46 of the storage tank 40 to above the liquid-driven rotating mechanism 30, as best shown in FIGS. 2 and 3. In general, it is anticipated that ambient air may be the best gas for gas 36 and that the air for gas 36 is taken from the ambient environment. Alternatively, the gas for gas 36 may be obtained from a gas vessel 52 that is part of a closed-loop gas supply 54 that, in one configuration, has a gas inlet line 56 that receives the gas 36 discharged from the gas discharge vents 34 and gas outlet line 58 that allows gas to flow to the source of pressurized gas 22. In other embodiments, the gas vessel 52 may be pressurized and itself function as the source of pressurized gas 22. Alternatively, the gas 36 for the supply of pressurized gas 22 may come directly from the gas discharge vents 34.

In the embodiments of the apparatus 10 shown in FIGS. 1-3, the source of pressurized gas 22 comprises a gas pump 60 connected to a source of power 62 that powers the gas pump 60 and a gas discharge line 64 that delivers the pressurized gas 36 to the flow chambers 26 to mix with the liquid 24 from the source of liquid 20 to produce the aerated flow stream 28, as best shown in FIGS. 2 and 3. In one embodiment, the gas pump 60 is an electrically operated air pump of the type that is utilized for discharging gas into water (i.e., an aqua air pump) and the source of power 62 for the gas pump 60 is an electrical power source that is electrically connected to the gas pump 60 via one or more wires, cables or other electrical lines 66. The electrical power source can be a standard wall outlet that receives power from an electrical power grid, a gas-powered generator or the like. Preferably, however, the electrical power source for the source of power 22 is selected for its clean, renewable energy properties, such as solar energy, wind energy or the like. In a preferred embodiment, the source of power 22 is one or more solar cells that can supply electricity to the electric gas pump 60 via the electrical line 66. As will be readily appreciated by persons familiar with solar cell systems, a battery or other electrical power storage device can be utilized to store electricity for use by the gas pump 60 at night or other periods of low solar output. In one embodiment, the gas pump 60 is a twenty watt air pump that can push up approximately 4,000 gallons of water per hour. One 210 watt solar cell can run ten of such pumps at once for use with multiple apparatuses 10.

In one embodiment of the apparatus 10 of the present invention, the gas discharge lines 64 pneumatically connect directly to the flow chambers 26 to deliver gas 36 to the liquid 24 to produce the aerated flow stream 28 that lifts the liquid 24 above the liquid-driven rotating mechanism 30. In the embodiments shown in FIGS. 1-3, the gas discharge lines 64 pneumatically connect to gas injectors 68 that inject the pressurized gas 36 into the flow chambers to create the desired amount of gas/liquid mixture for the aerated flow stream 28 in the flow chambers 26 to effectively and efficiently lift the liquid 24 to above the liquid-driven rotating mechanism 30. As will be readily appreciated by persons skilled in the art, the selection of the gas injectors 68 is likely to be a trial and error analysis based on various factors of the apparatus 10, including the type of liquid 24 utilized for the supply of liquid 20, the distance the liquid 24 must be raised, the volume of liquid 24 being lifted and the like.

The one or more flow chambers 26 are sized and configured to facilitate flow of the aerated flow stream 28 to a position above the liquid-driven rotating mechanism 30. In one embodiment, each one of the flow chambers 26 is defined by a tubular member. In FIGS. 1 and 2, the apparatus 10 comprises a pair of tubular members, shown as first tubular member 70 and second tubular member 72, that have interiors dimensioned as flow chambers 26. As will be readily appreciated by persons skilled in the art, the apparatus 10 is not limited to use of the two tubular members 70/72 with each tubular members 70/72 having one flow chamber 26. For instance, one or more of the tubular members, such as tubular member 70, can have a plurality of flow chambers 26 (instead of one flow chamber 26). In addition, the apparatus 10 can have only one tubular member (i.e., tubular member 70) or it can comprise more than two tubular members 70/72. As shown in FIG. 1, each tubular member 70/72 has an upper end 74 and a lower end 76. The storage tank 40 is hydraulically connected to each of the tubular members 70/72 at or near the lower end 76 thereof so liquid 24 will flow from the storage tank 40 to the flow chambers 26 inside the tubular members 70/72, preferably due to the hydrostatic head of the liquid 24 inside the storage tank 40. In the cross-sectional view of FIG. 2, the tank exit flow to the flow chambers 26 is shown with the arrows marked as 78. The inlet for the gas 36 into the flow chamber 26, which in the embodiment shown in the figures is a gas injector 68, is also positioned generally at or near the lower end 76 of the tubular members 70/72, preferably immediately above where the tank exit flow 78 enters the flow chambers 26, as shown in FIGS. 2 and 3. The aerated flow stream 28 will flow upward from the lower ends 76 to the upper ends 74 of the tubular members 70/72, as represented by the upward flow 80 (shown as the arrows in FIGS. 2 and 3.). In one configuration of apparatus 10 of the present invention, the storage tank 40 can be a pipe (such as a twelve inch diameter pipe), a fifty-five gallon drum or the like and the tubular members 70/72 can be a pair of two inch diameter pipes or the like.

In the embodiment of FIG. 3, the flow chambers 26 and storage tank 40 are formed by and within a housing 82 that has a plurality of internal walls 84 that form chambers which define the flow chambers 26 and storage tank 40. In addition to defining the flow chambers 26 and storage tank 40, the plurality of internal walls 84 support the liquid-driven rotating mechanism 30 above the storage tank 40, form a hydrostatic head area 86 located generally above the liquid-driven rotating mechanism 30 and define the liquid discharge device 32 that directs liquid 24 into the liquid-driven rotating mechanism 30. As with the embodiment shown in FIGS. 1 and 2, the liquid 24 in storage tank 40 will flow out the storage tank outlet 50, as exit flow 78, into the flow chambers 26 where the source of pressurized gas 22 will inject gas 36 to form the aerated flow stream 28 and create the upward flow 80. The aerated flow stream 28 will flow into the hydrostatic head area 86 via the liquid discharge device 32 and then flow into the liquid-driven rotating mechanism 30 to rotate the shaft 18 and produce the rotational torque that will be utilized by the work machine 16 to accomplish the desired work objective 19 (i.e., generate electricity, operate a pump or like work). As shown in FIG. 3, a portion of the internal walls 84 and the sidewalls 88 of the housing 82 define the flow chambers 26 through which the aerated flow stream 28 will produce the upward flow 80. The gas 36 will flow out the gas discharge vents 34 at the upper end 90 of the housing 82 and either vent to the atmosphere (as in FIGS. 1 and 2) or be directed into the closed-loop gas supply 54 (as in FIG. 3). The liquid 24 separated from the gas 36 will flow into the hydrostatic head area 86. In this embodiment, the liquid discharge device 32 may just be an opening from the flow chamber 26 into the hydrostatic head area 86 (unlike the nozzles of FIGS. 1 and 2 that are described below). After passing through and rotating the liquid-driven rotating mechanism 30, the liquid 24 will flow into the inlet 48 into the storage tank 40. Although the lower end 46 of the storage tank 40 is open, the lower end 92, sidewalls 88 and upper end 90 of the housing 82 are closed to contain the liquid 24 in the housing 82.

As set forth above, the liquid-driven rotating mechanism 30 of the apparatus 10 of the present invention is structured and arranged to convert the flowing liquid 24 of the hydrostatic head of the liquid 24 in the hydrostatic head area 86 to rotational force that rotates the shaft 18 and operates the work machine 16 to accomplish the work objective 19. In the embodiment of FIGS. 1 and 2, the liquid-driven rotating mechanism 30 comprises an open impeller 94 positioned inside the chamber 96 of a cone-shaped fluid diffuser 96 that is beneficially sized and configured to create a vortex inside the chamber 96 and direct the flow of liquid 24 to rotate impeller 94. The impeller 94 is attached to or integral with the output shaft 18 such that rotation of the impeller 94 will rotate the output shaft 18 and create the rotational torque that is utilized by the work machine 16 to accomplish the work objective 19. The configuration, use and operation of an open impellers in a fluid flow stream and a diffuser to direct fluid flow to the impeller are generally well known in the relevant art. As will be readily appreciated by such persons, the liquid 24 discharged by the liquid discharge devices 32, after separation and discharge of the gas 36 through the gas discharge vents 34, will rotate the impeller 94 and cause rotation of the output shaft 18. Although the moving liquid 24 itself may be sufficient to rotate the impeller 94, the use of the diffuser 98 to create the vortex in the chamber 96 is known to create additional force that can be utilized to increase the rotation of the impeller 94 and, therefore, increase the amount of rotational torque which is available for the work machine 16.

In the embodiment of FIG. 3, the liquid-driven rotating mechanism 30 is a water turbine 100 having a closed impeller (not shown) that rotates in response to liquid 24 flowing through the water turbine 100. With regard to the present invention, liquid 24 flows through water turbine 100 as a result of the hydrostatic pressure of the liquid 24 in the hydrostatic head area 86 above the liquid-driven rotating mechanism 30 to rotate the turbine runner (not show) portion of the water turbine 100 to rotate the output shaft 18. The configuration, use and operation of such water turbines are generally well known in the relevant art, particularly by persons who are familiar with micro hydro generator systems and the like. Generally, however, such systems must be placed in a location where the hydrostatic head necessary to force the water through the water turbine can be provided by a small reservoir or tank and the water to operate the water turbine is provided by natural flow (i.e., a river, stream or the like) or the water must be pumped into the reservoir or tank to continually supply the hydrostatic head for the water turbine. The apparatus 10, system 12 and method 14 of the present invention solves the problem with these hydro generator systems by utilizing the aerated flow stream 28, created by injecting gas 36 into the liquid 24, to raise the liquid 24 to the hydrostatic head area 86 where it can provide the required hydrostatic head to operate the water turbine 100.

The machines which can be utilized for the liquid-driven rotating mechanism 30 of the present invention are generally widely available and are somewhat affordable for small, localized work-producing systems, such as systems for generating electricity, operating a pump or accomplishing other useful work objectives 19. Such machines are commonly found in describing or selling components for micro hydro generator systems, micro hydro power systems, micro hydro turbines and the like. Often the water turbines are sold with the various components that make up the work machine 16, such as an electrical generator to generate electricity. One example is the Micro Hydro Power Propeller Turbine Arial ZD1.8-0.3 DCT4-Z offered on the website Micro-Hydro-Power.com. Another such machine is the 1.5 kw Axial Flow Turbine (also referred to as a micro hydro generator) available for purchase from the website Alibaba-.com.

The liquid discharge devices 32 are utilized to direct the liquid 24, after it is separated from the aerated flow stream 28 at the gas discharge vents 34, to the liquid-driven rotating mechanism 30, either directly as in the embodiments of FIGS. 1 and 2 or via the hydrostatic head area 86 of FIG. 3. As set forth above, the liquid discharge device 32 can be as simple as the open tubular outlet 102 shown in FIG. 3 that is provided merely to direct the liquid 24, which will be under pressure, into the hydrostatic head area 86 where the liquid 24 will flow through the water turbine 100 based on hydrostatic head. In the embodiment of FIGS. 1 and 2, however, the liquid discharge device 32 comprises a downward extending pipe 104 having a liquid nozzle 106 at the lower end thereof to further pressurize the water 24 and better direct the water 24 into the chamber 96 of the diffuser to increase the force available to rotate the impeller 94 and, as a result, the output shaft 18 to provide greater rotational torque at the work machine 16. In one example, both the size of the outlet of the nozzle 106 and the direction in which the outlet of the nozzle 106 is directed can be adjusted to improve the operation of the apparatus 10. As will be readily appreciated by persons skilled in the art, a wide variety of different types of nozzles 106 can be utilized for the liquid discharge device 32. The configuration and use of such nozzles 106 are generally well known to persons skilled in the relevant art.

The gas discharge vents 34 are sized and configured to facilitate the release of the gas 36 from the aerated flow stream 28 so that the liquid 24 that is directed to the liquid-driven rotating mechanism 30 is as free as the gas 36 as possible for improved operation of the apparatus 10. The gas discharge vents 34 comprise a generally upwardly extending pipe 108 having one or more outlets 110 to vent the gas 36 to the atmosphere, as in FIGS. 1 and 2, or to direct the gas 36 into the closed-loop gas supply 54 of FIG. 3. In either configuration, or other configurations, the gas discharge vents 34 can comprise one or more baffles and/or other gas/liquid separating devices, shown as 112 in FIG. 3, positioned in the tubular portion of the flow chambers 26 generally immediately at or upstream of where the gas discharge vents 34 are located to facilitate separation of the gas 36 from aerated flow stream 28 so that primarily, if not nearly exclusively, only liquid 24 is directed to the liquid-driven rotating mechanism 30. As will be readily appreciated by persons skilled in the art, the lower the amount of the gas 36 that is directed to the liquid-driven rotating mechanism 30, the higher the efficiency of the operation of the liquid-driven rotating mechanism 30 is likely to be obtained.

In one example configuration of the apparatus 10 of the present invention, the liquid 24 is water (either alone or mixed with chemicals, as set forth above), the gas 36 is air, the flow chambers 26 are defined by a pair of two inch diameter tubular members 70/72 that are approximately three feet in length, the source of liquid 20 is contained in a twelve inch pipe (as the storage tank 40) that maintains a level of water approximately eighteen inches below the upper end 74 of the tubular members 70/72 and the source of pressurized air 22 is a twenty watt electrical gas pump 60 that is configured to lift approximately 4,000 gallons of water per hour to provide approximately fifty feet of head. In a preferred configuration, the electrical gas pump 60 is powered by one or more solar panels, as the source of power 62. In this configuration, the apparatus will produce approximately 400 kw per hour or 9.6 kw per day. A typical home in the United States uses approximately 30 kw per day. As such, three of such apparatuses 10 connected together in series should be able to supply approximately all the electricity needed by a the typical American home.

A system 12 for producing rotational torque to accomplish a work objective 19 utilizing the apparatus 10 of the present invention is summarized in FIG. 4. As also shown on FIGS. 2 and 3, the system 12 comprises the apparatus 10 that produces the rotational torque via an output shaft 18, a work machine 16 that engages the rotating output shaft to perform the work for the work objective 19 and a source of power 62 to power the source of pressurized gas 22. As set forth above, the apparatus 10 for the system 12 comprises a source of liquid 20, a source of pressurized gas 22, one or more upwardly directed flow chambers 26, a liquid-driven rotating mechanism 30, an output shaft 18 connected to or integral with the liquid-driven rotating mechanism 30, one or more liquid discharge devices 32 and one or more gas discharge vents 34. In operation, the components of the system 12 result in liquid 24 from the source of liquid 20 flowing to the upwardly directed flow chambers 26 where, at or near the lower end of the flow chambers 26, gas 36 from the source of pressurized gas 34, which is powered by the source of power 62, is injected into the liquid 24 to produce an aerated flow stream 28 that flows upward in the flow chambers 26 to a position above the liquid-driven rotating mechanism 30. The gas 36 is separated from the aerated flow stream 28, for instance by using one or more gas/liquid separating devices 112, to vent the gas 36 from the flow chambers 26 through the gas discharge vents 34. The liquid 24 from aerated flow stream 28 is directed into the liquid-driven rotating mechanism 30 to rotate the output shaft 18. The rotational torque from the rotating output shaft 18 is engaged by the work machine 16 to accomplish the work objective 19.

A method 14 of producing rotational torque to accomplish a work objective 19 utilizing the apparatus 10 of the present invention is shown in FIG. 5. Initially, an apparatus 10 for producing rotational torque is provided and connected to a work machine 16 selected to accomplish the desired work objective 19, such as generate electricity, operate a pump or the like, and to a source of power 62 that is selected to provide power to the source of pressurized gas 22. The apparatus 10 should have the source of liquid 20 filled with a liquid 24, such as water or water mixed with chemicals (as set forth above) selected to provide benefits to the use and operation of the apparatus 10. As summarized in FIG. 5, the method 14 of the present invention comprises the following steps: (1) flowing liquid 24 from the source of liquid 20 into the flow chambers 26; (2) injecting gas 36 from the source of pressurized gas 22 into the flow chambers 26 to mix with the liquid 24 and produce an aerated flow stream 28 inside the flow chambers 26; (3) flowing the aerated flow stream 28 upward inside the flow chambers 26 to above the liquid-driven rotating mechanism 30; (4) separating the gas 36 from the aerated flow stream 28 and discharging the gas 36 through the gas discharge vents 34 to the atmosphere or a closed-loop gas supply 54; (5) discharging the liquid 24 from the liquid discharge devices 32 to the liquid-driven rotating mechanism 30; (6) rotating the liquid-driven rotating mechanism 30 with the liquid 24 to rotate output shaft 18; (7) flowing the liquid 24 back into the source of liquid 20; and (8) operating the work machine 16 with the rotating output shaft 18 to accomplish the work objective 19. In the embodiment of FIG. 3 with the closed-loop gas supply 54, the method 14 also includes the step of drawing gas 36 from a gas vessel 52 which stores gas 36 for use by the source of pressurized gas 22. In the embodiment where air is used for the gas 36, the source of pressurized gas 22 will draw the air 36 from the ambient environment.

In use, the apparatus 10, system 12 and method 14 of the present invention will produce rotational torque that can be beneficially utilized by a work machine 16 to accomplish the desired work objective 19, such as generating electricity, operating a pump or the like. In an embodiment where the liquid 24 is water, the new apparatus 10 is generally configured as a micro-hydro generator which uses the hydrostatic head created by gas-assisted lifted water (the aerated flow stream 28) to direct the water 24 to a water-driven rotating mechanism 30 that rotates the output shaft 18 which is connected to or integral with work machine 16. Because the water 24 is being lifted with the source of pressurized gas 22, via the aerated liquid stream 28 inside the flow chambers 26, the apparatus 10 reduces the amount of energy that would otherwise be required to lift the water 24. As will be readily appreciated by persons skilled in the art, the apparatus 10 is generally configured as a micro-hydro generator (or as a micro-hydroelectric generator) to operate a work machine 16 that can be utilized at a house, office, business or other location for the localized generation of electricity or other work objectives 19. As will also be readily appreciated by persons skilled in the relevant art, the apparatus 10, system 12 and method 14 of the present invention produce rotational torque that is relatively simple and inexpensive to manufacture, requires little ongoing maintenance and is efficient at producing rotational torque.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. An apparatus for producing rotational torque for use by a work machine to accomplish a work objective, said apparatus comprising:

a source of liquid having an upper end and a lower end, said source of liquid configured to allow a liquid to flow into said source of liquid at or near said upper end thereof and to allow said liquid to flow out an outlet at or near said lower end thereof;

one or more flow chambers, each of said flow chambers having an upper end and a lower end, said flow chambers hydraulically connected to said outlet at or near said lower end of said flow chambers so as to receive said liquid from said source of liquid through said outlet, said upper end of said flow chambers positioned above said source of liquid such that said liquid will flow from said flow chambers downward to said source of liquid upon exiting said flow chambers;

a source of pressurized gas configured to direct gas into each of said one or more flow chambers at or near said lower end of said flow chambers so as to mix with said liquid and form an aerated flow stream that flows upward from said lower end to said upper end of said flow chambers;

an output shaft configured to be operatively engaged by the work machine to accomplish the work objective;

a liquid-driven rotating mechanism disposed between said upper end of said flow chambers and said source of liquid and configured to receive said liquid from said flow chambers, said liquid-driven rotating mechanism attached to or integral with said output shaft, said liquid-driven rotating mechanism structured and arranged to rotate said output shaft in response to receiving said liquid and produce rotational torque that can be utilized by the work machine through said rotating output shaft;

one or more liquid discharge devices associated with each of said flow chambers at or near said upper end of said flow chambers, said liquid discharge devices configured to discharge said liquid from said flow chambers downward toward to said liquid-driven rotating mechanism; and one or more gas discharge vents associated with each of said flow chambers at or near said upper end of said flow chambers upstream of said liquid discharge devices, said gas discharge vents configured to discharge said gas from said aerated flow stream so as to substantially flow said liquid downstream of said gas discharge vents to said liquid discharge devices, wherein said liquid hydrostatically flows from said source of liquid into each of said one or more flow chambers to mix with said gas from said source of pressurized gas and produce said aerated flow stream that lifts said liquid above said liquid-driven rotating mechanism where said liquid is directed by said liquid discharge devices to said liquid-driven rotating mechanism to rotate said output shaft and operate the work machine.

2. The apparatus of claim 1, wherein said source of liquid is a storage tank having one or more sidewalls.

3. The apparatus of claim 2, wherein each of said one or more flow chambers are defined by one or more tubular members.

4. The apparatus of claim 2, wherein said storage tank and said one or more flow chambers are disposed in a housing having a plurality of internal walls that define said flow chambers.

5. The apparatus of claim 4, wherein said internal walls support said liquid-driven rotating mechanism above said storage tank.

6. The apparatus of claim 4 further comprising a hydrostatic head area disposed in said housing between said upper end of said flow chambers and said liquid-driven rotating mechanism, said hydrostatic head area sized and configured to receive said liquid from said flow chambers and to flow said liquid to said liquid-driven rotating mechanism so as to operate said liquid-driven rotating mechanism and rotate said output shaft.

7. The apparatus of claim 1, wherein each of said one or more flow chambers are defined by one or more tubular members.

8. The apparatus of claim 1 further comprising a hydrostatic head area positioned above said liquid-driven rotating mechanism, said hydrostatic head area sized and configured to receive said liquid from said flow chambers and to flow said liquid to said liquid-driven rotating mechanism so as to operate said liquid-driven rotating mechanism and rotate said output shaft.

9. The apparatus of claim 1, wherein said liquid-driven rotating mechanism comprises an open impeller disposed in a chamber of a diffuser.

10. The apparatus of claim 1, wherein said liquid-driven rotating mechanism is a water turbine.

11. The apparatus of claim 1, wherein said gas discharge vents are pneumatically connected to a closed-loop gas supply comprising a gas vessel for storing said gas, a gas inlet line for delivering said gas from said gas discharge vents to said gas vessel and a gas outlet line for delivering said gas to said source of pressurized gas.

12. The apparatus of claim 1, wherein said source of pressurized gas comprises a gas pump connected to a source of power, said source of power selected so as to power said gas pump and pressurize said gas.

13. The apparatus of claim 1 further comprising one or more gas/liquid separating devices generally at or upstream of said gas discharge vents to facilitate separation of said gas from said aerated flow stream.

14. The apparatus of claim 1, wherein said liquid discharge devices comprise a nozzle for pressurizing said liquid from said flow chambers and/or directing said liquid from said flow chambers to said liquid-driven rotating mechanism.

15. An apparatus for producing rotational torque for use by a work machine to accomplish a work objective, said apparatus comprising:

a source of liquid, said source of liquid configured as a storage tank having an upper end and a lower end, said source of liquid configured to allow a liquid to flow into said source of liquid at or near said upper end of said storage tank and to allow said liquid to flow out an outlet at or near said lower end of said storage tank;

one or more flow chambers, each of said flow chambers having an upper end and a lower end, said flow chambers hydraulically connected to said outlet at or near said lower end of said flow chambers so as to receive said liquid from said source of liquid through said outlet, said upper end of said flow chambers positioned above said source of liquid such that said liquid will flow from said flow chambers downward to said source of liquid upon exiting said flow chambers;

a source of pressurized gas configured to direct gas into each of said one or more flow chambers at or near said lower end of said flow chambers so as to mix with said liquid and form an aerated flow stream that flows upward from said lower end to said upper end of said flow chambers, said source of pressurized gas comprising a gas pump connected to a source of power, said source of power selected so as to power said gas pump and pressurize said gas;

an output shaft configured to be operatively engaged by the work machine to accomplish the work objective;

a liquid-driven rotating mechanism disposed between said upper end of said flow chambers and said source of liquid and configured to receive said liquid from said flow chambers, said liquid-driven rotating mechanism attached to or integral with said output shaft, said liquid-driven rotating mechanism structured and arranged to rotate said output shaft in response to receiving said liquid and produce rotational torque that can be utilized by the work machine through said rotating output shaft;

one or more liquid discharge devices associated with each of said flow chambers at or near said upper end of said flow chambers, said liquid discharge devices configured to discharge said liquid from said flow chambers downward toward to said liquid-driven rotating mechanism;

one or more gas discharge vents associated with each of said flow chambers at or near said upper end of said flow chambers upstream of said liquid discharge devices, said gas discharge vents configured to discharge said gas from said aerated flow stream so as to substantially flow said liquid downstream of said gas discharge vents to said liquid discharge devices; and one or more gas/liquid separating devices generally at or upstream of said gas discharge vents to facilitate separation of said gas from said aerated flow stream, wherein said liquid hydrostatically flows from said source of liquid into each of said one or more flow chambers to mix with said gas from said source of pressurized gas and produce said aerated flow stream that lifts said liquid above said liquid-driven rotating mechanism where said liquid is directed by said liquid discharge devices to said liquid-driven rotating mechanism to rotate said output shaft and operate the work machine.

16. The apparatus of claim 15, wherein said storage tank and said one or more flow chambers are disposed in a housing having a plurality of internal walls that define said flow chambers.

17. The apparatus of claim 16 further comprising a hydrostatic head area disposed in said housing between said upper end of said flow chambers and said liquid-driven rotating mechanism, said hydrostatic head area sized and configured to receive said liquid from said flow chambers and to flow said liquid to said liquid-driven rotating mechanism so as to operate said liquid-driven rotating mechanism and rotate said output shaft.

18. A method for producing rotational torque to be utilized by a work machine to accomplish a work objective, said method comprising the steps of:

(a) providing an apparatus having a source of liquid, a source of pressurized gas, one or more flow chambers hydraulically connected to said source of liquid and pneumatically connected to said source of pressurized gas, a liquid-driven rotating mechanism structured and arranged to rotate an output shaft in as a result of receiving a liquid from said source of liquid, one or more liquid discharge devices in fluid flow communication with said flow chambers to discharge said liquid toward said liquid-driven rotating mechanism and one or more gas discharge vents pneumatically connected said flow chambers to discharge a gas from said flow chambers upstream of said liquid discharge devices;

(b) flowing said liquid from said source of liquid into said flow chambers;

(c) injecting said gas from said source of pressurized gas into said flow chambers to mix with said liquid and produce an aerated flow stream inside said flow chambers;

(d) flowing said aerated flow stream upward inside said flow chambers to above said liquid-driven rotating mechanism;

(e) discharging said gas through said gas discharge vents;

(f) discharging said liquid from said liquid discharge devices toward said liquid-driven rotating mechanism;

(g) rotating said liquid-driven rotating mechanism with said liquid to rotate said output shaft;

(h) flowing said liquid back into said source of liquid; and (i) operating said work machine with said rotating output shaft to accomplish said work objective.

19. The method of claim 18 further comprising the step of separating the gas from said aerated flow stream with one or more gas/liquid separating devices at or upstream of said gas discharge vents before said gas discharging step.

20. The method of claim 18 further comprising the step of directing said gas to one of the atmosphere and a closed-loop gas supply after said gas discharging step.

* * * * *